US005607083A

United States Patent [19]

Vogel et al.

[11] Patent Number: 5,607,083

[45] Date of Patent: Mar. 4, 1997

[54] BEVERAGE DISPENSING VALVE

[75] Inventors: James D. Vogel; Paul J. Henry, both of Anoka; William G. Mertes, Ramsey, all of Minn.

[73] Assignee: IMI Cornelius Inc., Anoka, Minn.

[21] Appl. No.: 122,602

[22] PCT Filed: May 21, 1993

[86] PCT No.: PCT/US93/04957

§ 371 Date: May 1, 1995

§ 102(e) Date: May 1, 1995

[87] PCT Pub. No.: WO93/24406

PCT Pub. Date: Dec. 9, 1993

[51] Int. Cl.[6] ..... B67D 5/56

[52] U.S. Cl. ..... 222/129.1

[58] Field of Search ..... 222/129.1–129.4, 222/564; 239/590.5

[56] References Cited

U.S. PATENT DOCUMENTS 4,928,854 5/1990 McCann et al. ..... 222/129.1

4,986,447 1/1991 McCann et al. ..... 222/129.1

5,033,648 7/1991 Nakayama et al. ..... 222/129.1

5,048,726 9/1991 McCann et al. ..... 222/129.1

5,269,442 12/1993 Vogel ..... 222/129.1

*Primary Examiner*—Gregory L. Huson

*Attorney, Agent, or Firm*—Sten Erik Hakanson

[57] ABSTRACT

A post-mix beverage dispensing valve is shown that provides for assembly thereof substantially manually. This easy assembly is provided for by a plurality of snap fitting component structures. A nozzle is also shown that provides for higher flow rates. Lever operated and electronic operated embodiments of the valve are also shown. The valve is also particularly designed to provide for an electronic switch/control module separate from the valve housing cover. The valve further includes improved banjo valves and accompanying seat structures to provide for increased fluid flow and for fluid flow that is less turbulent.

30 Claims, 9 Drawing Sheets

14

149
147
148
140a
138
148
140b
149a
148b
116
114
118
124
112
196
132
196
126
128
16
106
106
128
222
108
126
265a
104
60
294
23a
61
110
41

33
B
35
34
36
37
58
56
54
38a
38
98
96
68
66
32b
50
64
W
P
44
44a
44b
45
44c
S
M
L
46a
46b
46c
47
42
32
A

BEVERAGE DISPENSING VALVE

BACKGROUND OF THE INVENTION

1. Field of the Invention

The present invention relates generally to beverage dispensing valves and, in particular, to post-mix beverage dispensing valves.

2. Background

Post-mix beverage dispensing valves are well known in the prior art and provide, in the nozzle structure thereof, for the simultaneous mixing of a water and syrup component for the production of a beverage. Standard flow rates for such valves are typically 1 ½ to 3 ounces per second; however, flow rates of 4½ to 6 ounces are now also becoming desirable. However, the higher flow rates present a challenge as there exists a greater possibility for foam production, improper brix and loss of carbonation. Accordingly, it would be highly desirable to provide for a post-mix nozzle that accommodates such higher flow rates and does so with a structure that is relatively simple in design and that easy and inexpensive to manufacture.

In addition, as post-mix valves are required to provide an accurate brix at a desired flow rate, and to maintain such precision it is well understood in the industry that such valves periodically need cleaning, adjusting and other maintenance. Accordingly, it would be desirable to have a post-mix valve wherein the internal components are quickly and easily accessible, adjustable and repairable. And in particular, it would be desirable to provide for such easy access in an electronic portion controlled valve.

SUMMARY OF THE INVENTION

A nozzle for a post-mix beverage dispensing valve is shown for optimizing flow at flow rates above 3.5 oz./sec. The nozzle includes a first diffuser plate followed by a central flow piece having a frusto-conical outer water flow surface and an interior syrup flow channel. Second and third diffuser plates follow the frusto-conical portion. The three diffuser plates have perimeter edges that contact the inner surface of a nozzle housing so that the carbonated water must flow through holes in the diffusers. In this manner the gradual reduction of pressure of the carbonated water to atmospheric can be controlled in part by increasing the surface area of the holes in each successive diffuser.

The present invention further includes a valve housing including a main valve housing portion, a valve base and a front access cover. The main housing portion is first slideably engageable with the valve base, after which the front cover is slideably engageable with the main housing portion in a direction substantially transverse to the sliding engagement of the housing portion with the valve base. In addition, when the access cover is slideably engaged with the valve base, the access cover prevents the main housing portion from disengaging from the valve base. In this manner, the housing covering the internal working components of the present beverage valve can be removed quickly and easily to provide for access thereto. In the present invention, the interior components are arranged to provide space for an electronic control/switch module. The access cover is modified to accommodate the module wherein the two are not physically connected. Thus, the interior of the valve can be more easily accessed as compared to prior art electronic pour controlled valves wherein the control switches are secured to the access cover and wired to interior valve components. The valve body of the invention herein also includes a number of snap-fitting parts. Thus, in combination with a snap together housing, the present valve can be assembled by hand with a minimum need for any tools.

The present invention also uses banjo valves having valve seats that have been improved for better flow characteristics. In this manner carbon dioxide gas retention is increased.

A quick disconnect is shown that provides for sure retention of the valve to a dispenser, yet is easily operated to allow for quick removal of the valve therefrom.

DESCRIPTION OF THE DRAWINGS

A better understanding of the structure and the objects and advantages of the present invention can be had by reference to the following detailed description which refers to the following figures, wherein.

DETAILED DESCRIPTION

Figure 1:
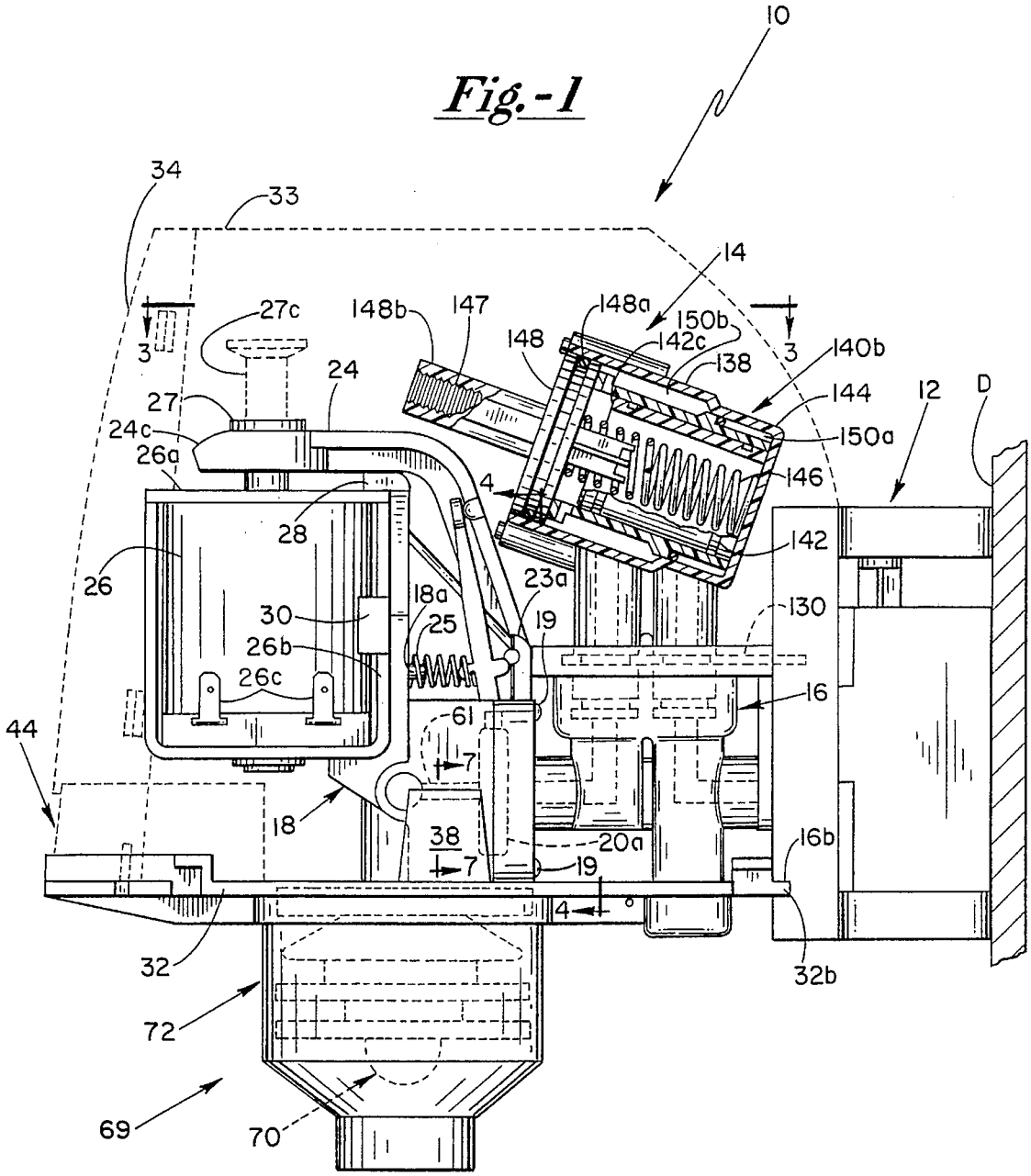
FIG. 1 shows a side plan partial cross-sectional view of the valve of the present invention.
Figure 4:
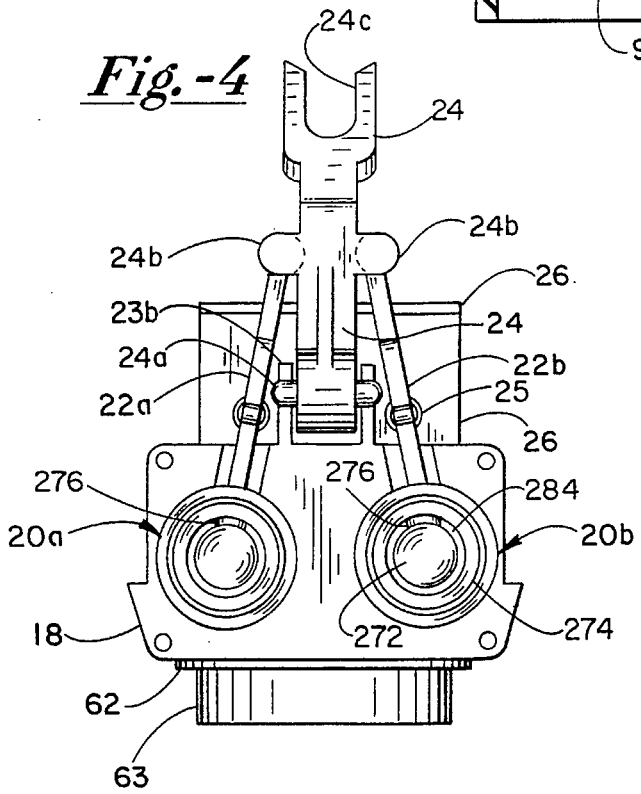
FIG. 4 shows a end plan view along lines 4—4 of FIG. 1.

The post-mix beverage dispensing valve of the present invention is seen in FIG. 1 and referred to by the numeral 10. Valve 10 includes a quick disconnect 12 and a modular or interchangeable flow control 14. Disconnect 12 is secured to a beverage dispenser D, such as a beverage dispensing tower or the like, and provides for releasable connection to sources of carbonated water and syrup, not shown, as will be described in greater detail below. Flow control 14 is releasably secured to flow control valve body portion 16, as will also be described in greater detail below. Portions 16 and 18 are secured together by a plurality of screws 19. As seen by also referring to FIG. 4, a pair of banjo valves 20*a* and 20*b* are secured between body portions 16 and 18 and include valve arms 22*a* and 22*b*.

Figure 3:
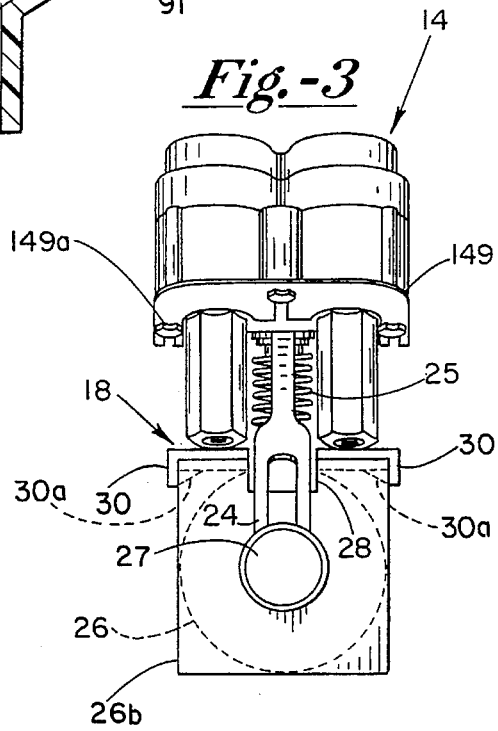
FIG. 3 shows an top plan view along lines 3—3 of FIG. 1.

A valve actuating arm 24 is secured between extensions 23*a* and 23*b* of body portions 16 and 18 respectively, by a pivot pin 24*a*, and includes horizontal extensions 24*b* for cooperating with arms 22*a* and 22*b*. A pair of return springs 25 extend between arms 22*a* and 22*b* and retaining protrusions 18*a* of body portion 18. A solenoid 26 has an outer metal jacket having a top portion 26*a* and a U-shaped portion 26*b* and has electrical contacts 26*c*. An operating piston 27 and is slideably connected with arm 24. Specifically, arm 24 includes a slotted forked end 24*c* for cooperating with a groove 27*a* of piston 27. In particular, as seen by also referring to FIG. 3, body portion 18 includes a top tab retainer 28 and flexible side tabs 30. Tabs 30 include returns 30*a* to provide for snap fitting engagement with solenoid jacket 26*b* for securing solenoid 26 to body portion 18.

Figure 6:
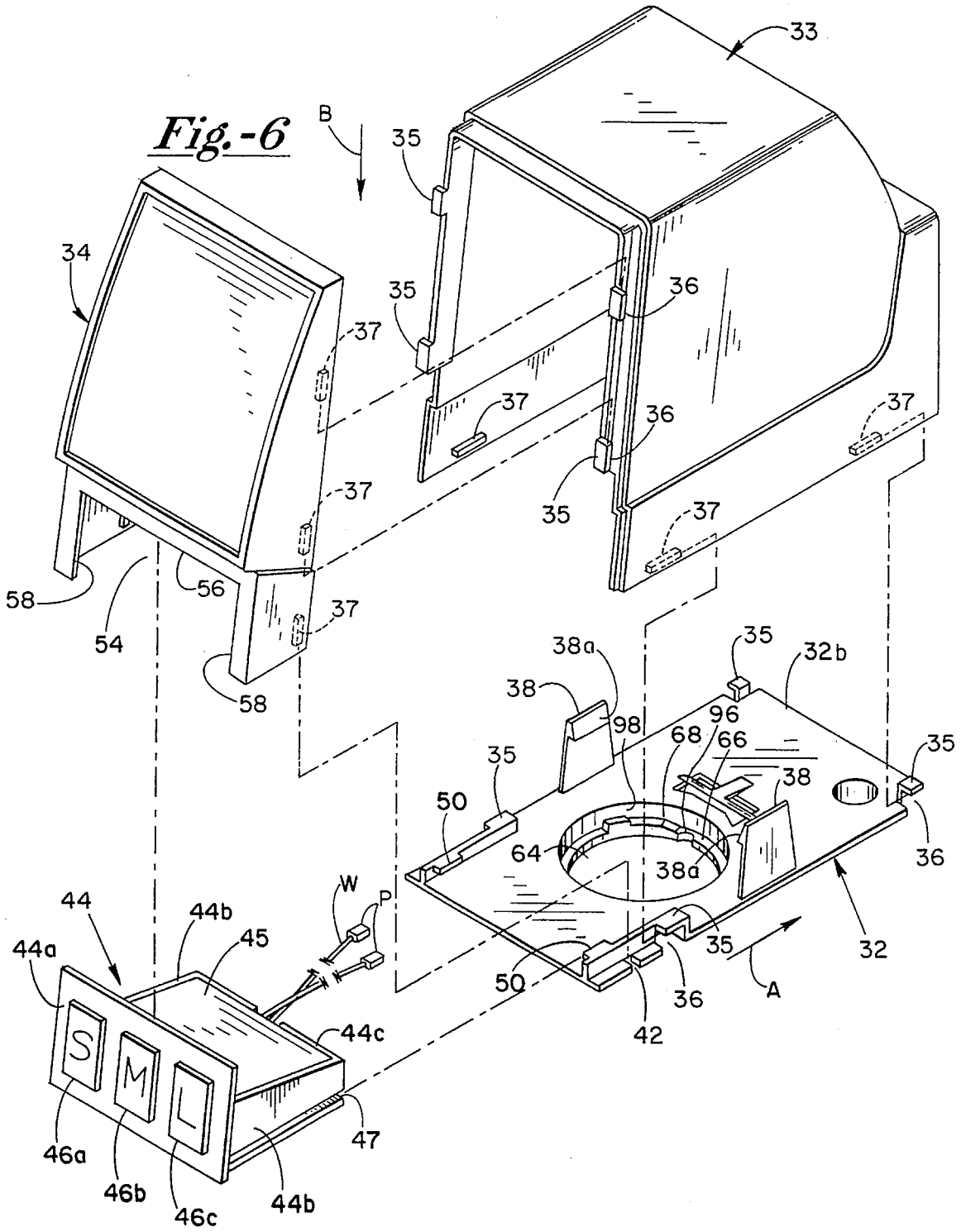
FIG. 6 shows a perspective view of the outer housing, access plate and base plate of the valve of the present invention.
Figure 7:
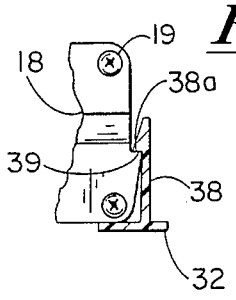
FIG. 7 shows an enlarged cross-sectional view along lines 7—7 of FIG. 1.
Figure 8:
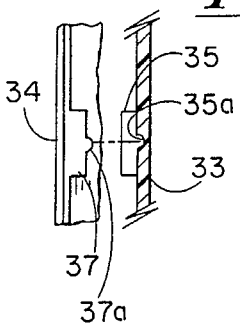
FIG. 8 shows an enlarged cross-sectional detail view of the interlocking of the access cover and housing.

As seen in FIG. 6, valve 10 includes an outer housing consisting of a base 32, a main outer housing 33 and an access cover 34. Base 32 and housing 33 include a plurality of L-shaped tabs 35 defining slots 36. Housing 33 and access cover 34 each include a plurality of ridges 37 for cooperating with slots 36. In particular, as seen by referring to FIG. 8, the ridges 37 of cover 34 include small protrusions 37*a* for cooperating with grooves 35*a* formed in the tabs 35 of housing 33. As seen by referring to FIG. 7, base plate 32 includes two snap-fitting arms 38 having return portions 38*a* for providing snap-fitting engagement of base 32 to valve block 18 by cooperation with shoulders 39 thereof. Base 32 further includes an edge end 40 for fitting into a corresponding groove 41 of valve portion 16, and includes notches 42 for cooperating with two bottom ridges 37 of cover 34.

As seen in FIG. 6, valve 10, in the electronic portion controlled version thereof, includes an electronics retaining drawer 44. Drawer 44 has a front end 44*a*, sides 44*b* and a rear end 44*c* defining an electronics retaining space 45. End 44*a* includes a plurality of size selection switches 46*a*, 46*b*, and 46*c* connected to a circuit board, not shown, encapsulated in space 45. The circuitry provides for dispensing control of valve 10, via wires W having plug ends P secured to contacts 26*c* and an electrical power source, wherein various sized drinks are automatically dispensed based upon pre-programming thereof. Thus, as is well known in the art, activation of one of the switches 46*a–c* provides for a particular volume of dispensed beverage as a function of the time of valve operation. Drawer 44 includes grooves 47 for cooperation with tabs 50 of base 32 so that drawer 44 can be removably engaged therewith. Cover 34 also includes a recessed opening 54 defined by a horizontal perimeter lip edge 56 and vertical edges 58.

Figure 5:
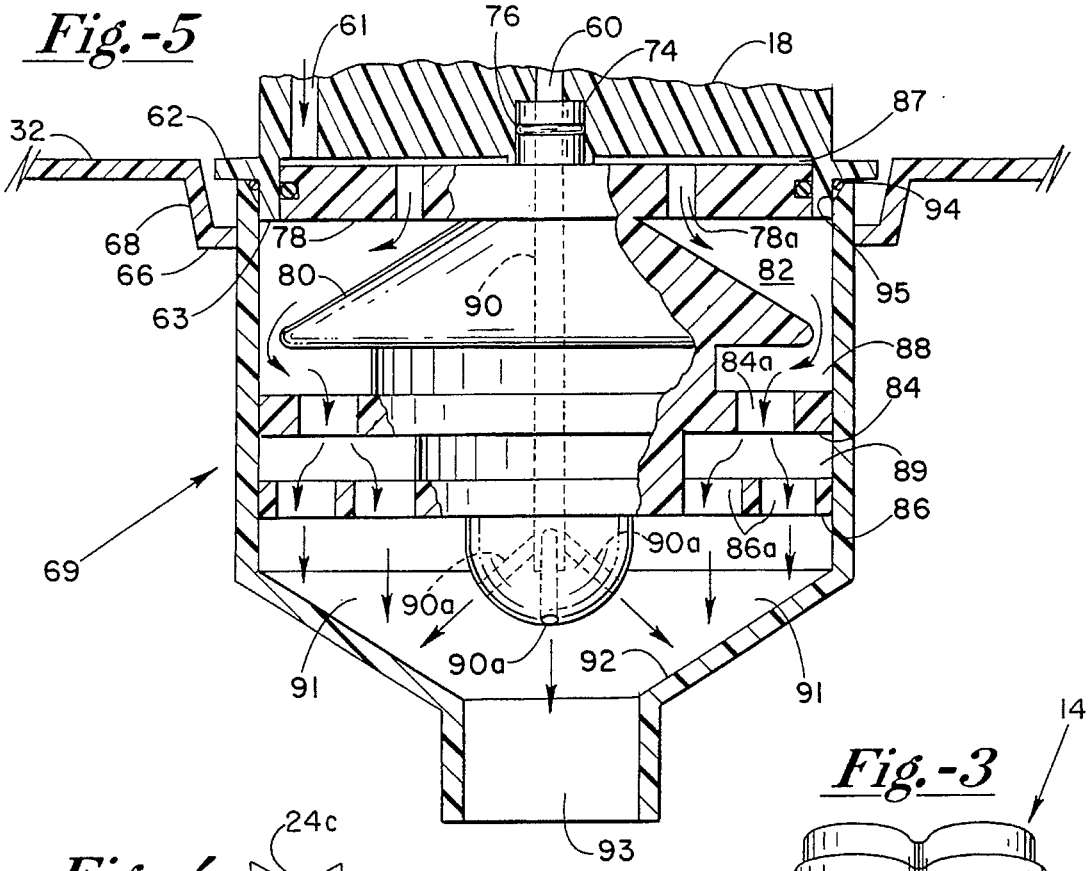
FIG. 5 shows an enlarged cross-sectional view of the nozzle of the present invention.

As seen in FIGS. 1 and 5, body portion 18 includes a syrup channel 60, a carbonated water channel 61, a horizontal perimeter rim 62 and a vertical perimeter rim 63. Valve body portion 18 extends, in part, into a hole 64 extending through plate 32. Plate 32 includes a horizontal lip 66 and vertical area 68 extending around and defining the perimeter of hole 64. A nozzle 69 is releasably securable to body portion 18 and base plate 32 and includes two primary components, a pressure reducing central portion 70 and an outer retainer or housing 72. Pressure reducer 70 includes a tube end portion 74 having an o-ring 76 extending there around and sized for sealable inserting into syrup channel 60. Tube end 74 is integral with a first plate 78 having a plurality of holes 78*a* extending there through. A frusto-conical portion 80 extends from plate 78 and defines an annular space 82 between portion 80, plate 78 and retainer 72. A second plate 84 is spaced from portion 80 and includes a plurality of holes 84 there through. A third plate 86 is spaced from second plate 84 and also includes a plurality of holes 86 there through. An annular space 87 exists between plate 78 and body portion 18 and an annular space 88 exists between portion 80 and second plate 84. A further annular space 89 is defined between second plate 84 and third plate 86. A syrup channel 90 extends through central portion 70, and terminates with a plurality of angled syrup channels 90*a*. Channels 90*a* provide for dispensing of syrup into a nozzle mixing space 91 for combining thereof with carbonated water as described more fully below. Retainer 72 includes an angled shoulder 92 and a dispensing orifice 93. Retainer 72 also includes a chamfer 95 around a top edge thereof for cooperating with an o-ring 94 extending around rim 63 at the juncture thereof with rim 62 for providing sealing of space 82. Retainer 72, and in turn, pressure reducer 74 held therein, are secured to base plate 32 by a bayonet fitting. Specifically, tabs, not shown, extending from retainer 72 opposite chamfer 95 are inserted into slots 96 of lip 62, after which retainer 72 is turned causing the retainer tabs to ride upwardly on ramps 98 drawing retainer 72 into sealing engagement between lip 62 of plate 32 and body portion 18.

Figure 10:
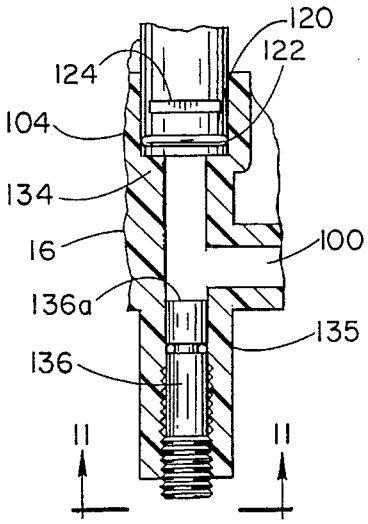
FIG. 10 shows an enlarged cross-sectional view along lines 10—10 of FIG. 15.
Figure 12:
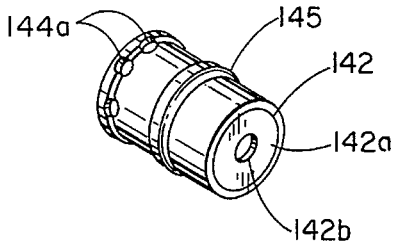
FIG. 12 shows a perspectives view of a piston and sleeve of the flow control.
Figure 11:
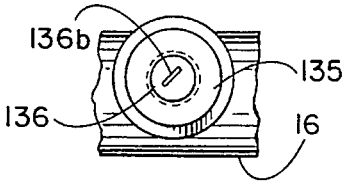
FIG. 11 shows a bottom plan view along lines 11—11 of FIG. 10.

As seen by referring to FIGS. 1, 2, 15, and 16, valve portion 16 includes a carbonated water inlet channel 100 and a syrup inlet channel 102. Inlet channels 100 and 102 extend through columns 104 and 106 respectively, and outlet channels 60 and 61 extend through columns 108 and 110 respectively. Columns 104, 106, 108, and 110 provide for receiving legs 112, 114, 116 and 118 respectively of flow control 14. Legs 112, 114, 116, and 118 include annular grooves 120 for retaining o-rings 122 and include notches 124. Flow control 114 is releasably securable to valve portion 16 wherein legs 112, 114, 116, and 118 are insertable into columns 104, 106, 108, and 110 respectively. Columns 104, 106, 108, and 110 include collars 126 having slots 128 extending there through, which slots are in alignment with end holes 130. A U-shaped metal rod 132 is insertable through holes 130 and slots 128 for cooperating with notches 124, and in this manner secures flow control 14 to valve portion 16. As seen by referring to FIGS. 10 and 11, legs 112, 114, 116, and 118 rest against shoulders 134 of columns 104, 106, 108, and 110 also. Column 104 also includes a lower portion 135 in which a flow restrictor 136 is threadably engaged. Restrictor 136 includes a head 136*a* and a bottom adjustment slot 136b. An o-ring 137 provides for fluid sealing of restrictor 136. Base plate 32 includes a well 135*a* for receiving lower column portion 135.

As is known in the art, and as seen by referring to FIGS. 1, 2, 10, 11, and 12, flow control 14 includes a main body 138 having two halves 140*a* and 140*b*. Half 140*a* provides for flow control of the liquid syrup and half of 140*b* provides for flow control of the carbonated water. In particular, each half 140*a* and 140*b*, include a piston 142 slideably secured within a sleeve 144 and biased by a spring 146. Piston 142 includes a flat piston surface 142*a* having a central orifice 142*b*, and an end perimeter edge 142*c*. Sleeve 144 includes a plurality of flow holes 144*a* around a perimeter end thereof, and has an o-ring 145 extending around the central exterior thereof. The tension on spring 146 is adjusted by a threaded tensioning means 147 for regulating the rate of flow of the respective liquid through each flow control half 140*a* and 140*b*. Each flow control half also includes a sealing and retainer plate 148. Plates 148 are sealed by o-rings 148*a* and include adjustment nozzles 148*b* through which adjustment tensioning means 147 are threadably engaged. Plates 148 are held on body 138 by a retainer 149 secured to body 138 by a plurality of screws 149*a*. It can be seen that fluidly separate annular spaces 150*a* and 150*b* are formed between sleeve 144 and body 138.

Figure 18:
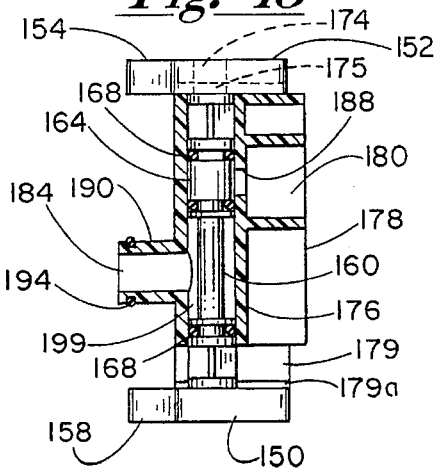
FIG. 18 shows a cross-sectional view along lines 18—18 of FIG. 20.
Figure 19:
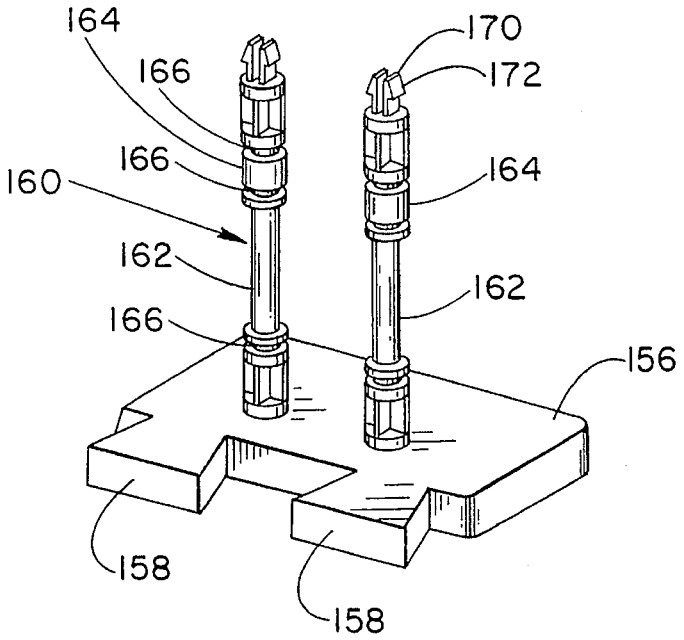
FIG. 19 shows an internal perspective view of the valve rods of the quick disconnect.
Figure 20:
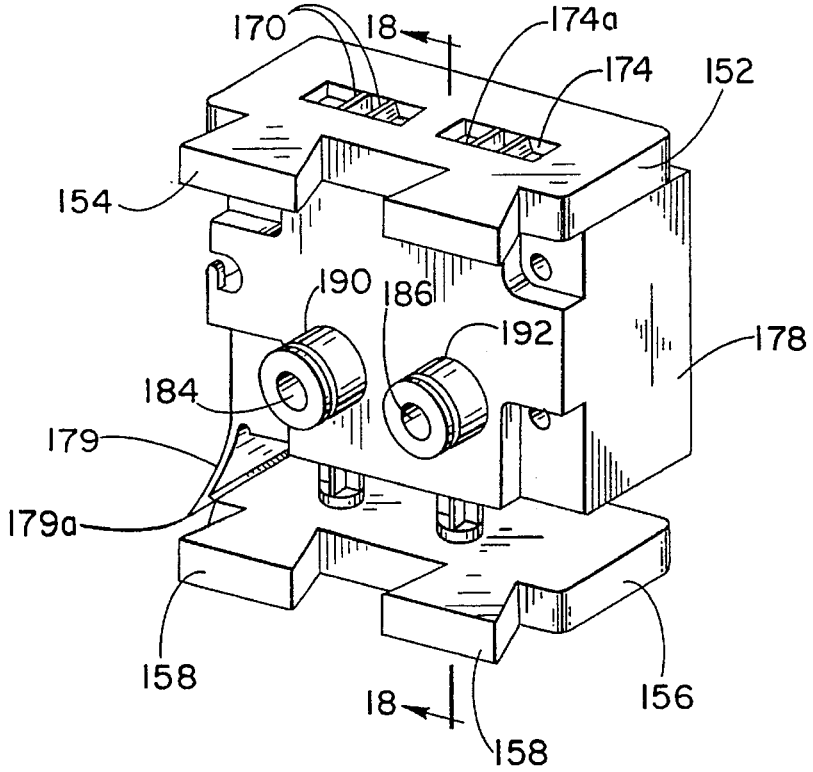
FIG. 20 shows a front perspective view of the quick disconnect of the present invention.
Figure 23:
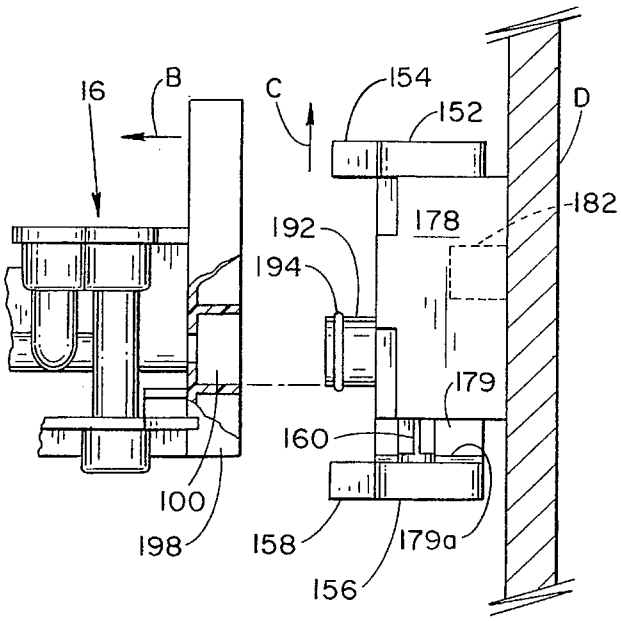
FIG. 23 shows the removal of the valve herein from the quick disconnect.
Figure 22:
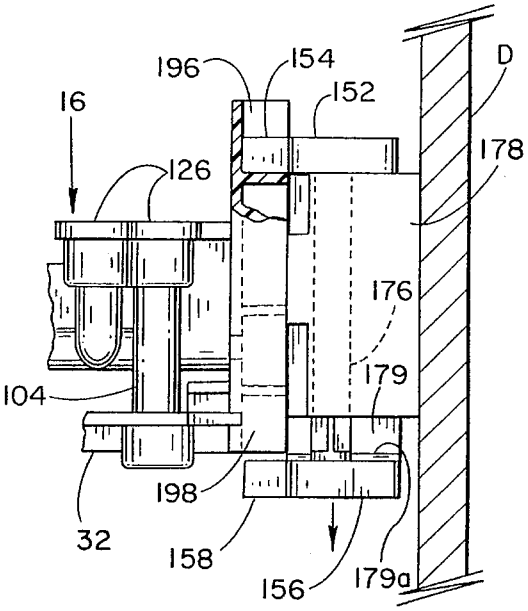
FIG. 22 shows the direction of operation of the quick disconnect of the present invention.

As seen in FIGS. 15, 16 and 18–23, disconnect 12 provides for releasable securing of valve 10 to support structure D. Disconnect 12 includes a top plate 152 having a pair of trapezoidially shaped interlocking tabs 154, and a further bottom plate 156 also having a pair of tabs 158. Bottom plate 156 includes a pair of rods 160 secured thereto. Rods 160 include a reduced diameter portion 162, a blocking portion 164, and three annular grooves 166 for retaining o-rings 168. Each rod 160 also includes a pair of flexible extensions 170 having returns 172. Plate 152 has a pair of slots 174 defining recessed floor surfaces 174a. Holes 175 extend through floor surfaces 174*a*. As seen in FIG. 18, rods 160 extend through bores 176 of a disconnect block 178. Block 178 includes a flange portion 179 having a retaining end 179*a*. Bores 176 are in fluid communication with syrup inlet 180 and carbonated water inlet 182, and are in fluid communication with syrup outlet 184 and water outlet 186. Each inlet 180 and 182 includes a reduced diameter opening 188, and outlets 184 and 186 extend through connecting tubes 190 and 192 respectively. Tubes 190 and 192 include o-rings 194 that provide for sealing insertion thereof into channels 102 and 100 respectively of valve body portion 16. Body portion 16 includes upper tab retaining pockets 196 and lower tab retaining pockets 198. An annular space 199 is defined around reduced diameter portion 162.

Figure 2:
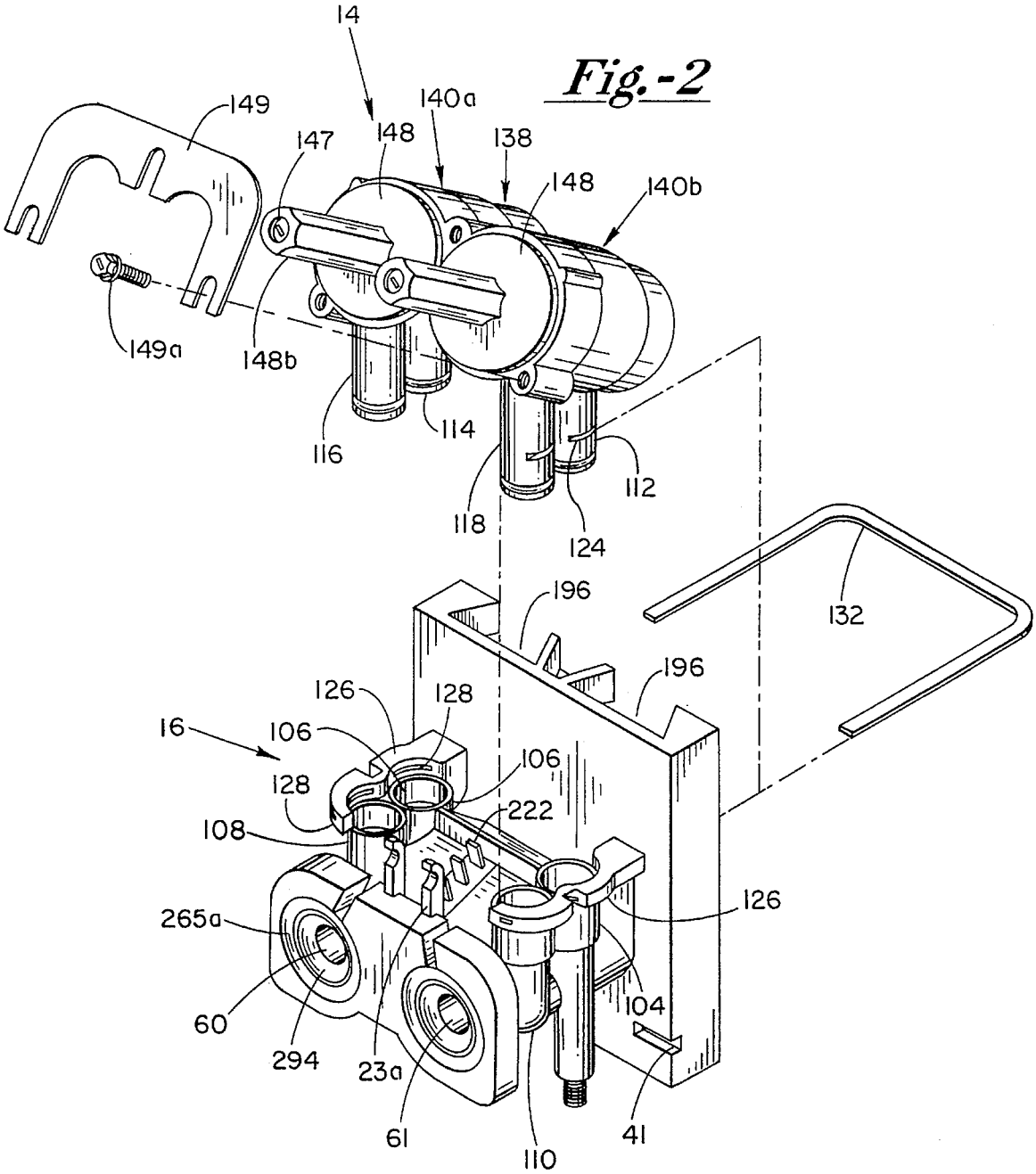
FIG. 2 shows an enlarged perspective exploded view of a portion of the valve of the present invention.
Figure 9:
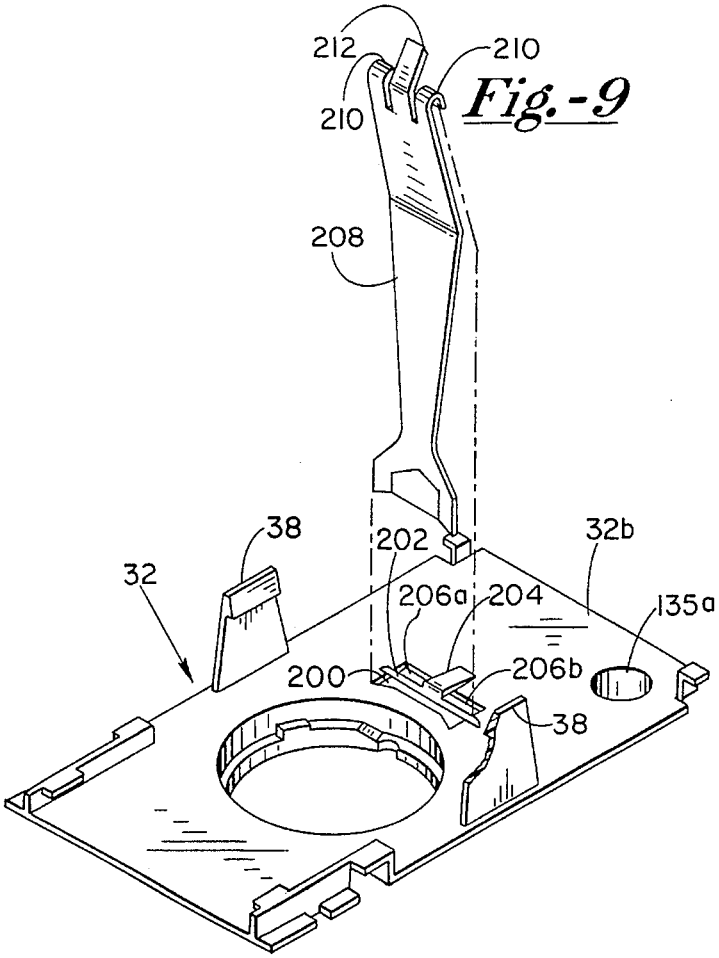
FIG. 9 shows a perspective exploded view of the base plate and operating lever.
Figure 17:
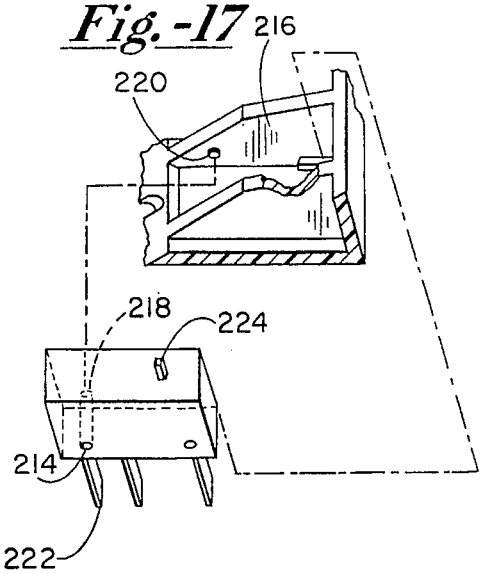
FIG. 17 shows an exploded perspective view of the micro switch and retaining pocket therefor.

As seen in FIGS. 9 and 17, in the lever operated embodiment of the invention herein, base plate 32 includes an opening 200 having a rod 202 extending there across. Rod 202 includes a divider 204 for defining two further openings 206*a* and 206*b*. Openings 200, 206*a* and 206*b* provide for the retaining of a lever arm 208. Specifically, arm 208 includes a pair of tabs 210 and a micro switch operating tab 212. Arm 208 is inserted through opening 200 wherein hooked tabs 210 provide for suspending lever arm 208 from rod 202, and wherein tab ends 210 extend into holes 206*a* and 206*b*. A micro switch 214 is releasably retained in a switch retaining pocket 216 of body portion 16. In particular, switch 214 includes tabs 218 for cooperation with indents 220 for providing snap-fitting retaining of switch 214 in pocket 216. In this manner, switch electrical contacts 222 are oriented upwardly with respect to valve 10, as seen in FIG. 2, and switch operating button 224 of switch 214 as oriented downwardly. In this manner, tab 212 of lever arm 208 provides for operating of switch 214 by contacting button 224.

Figure 13:
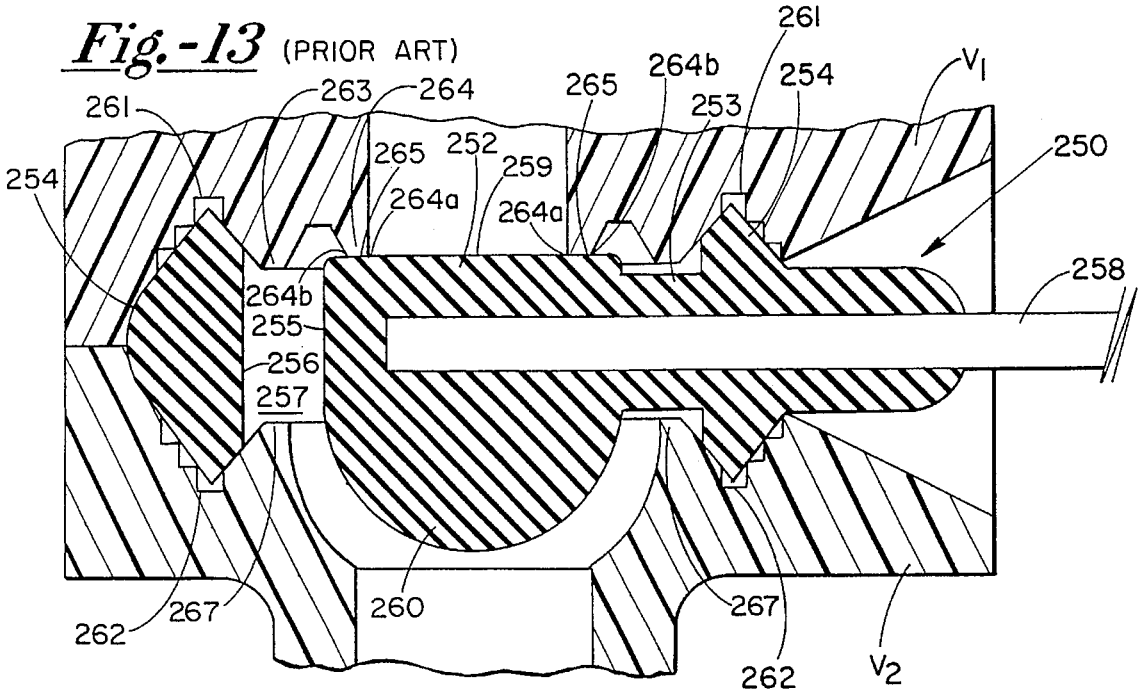
Fig.-13 (PRIOR ART)
FIG. 13 shows an example of a prior art banjo valve and accompanying valve seat.
Figure 14:
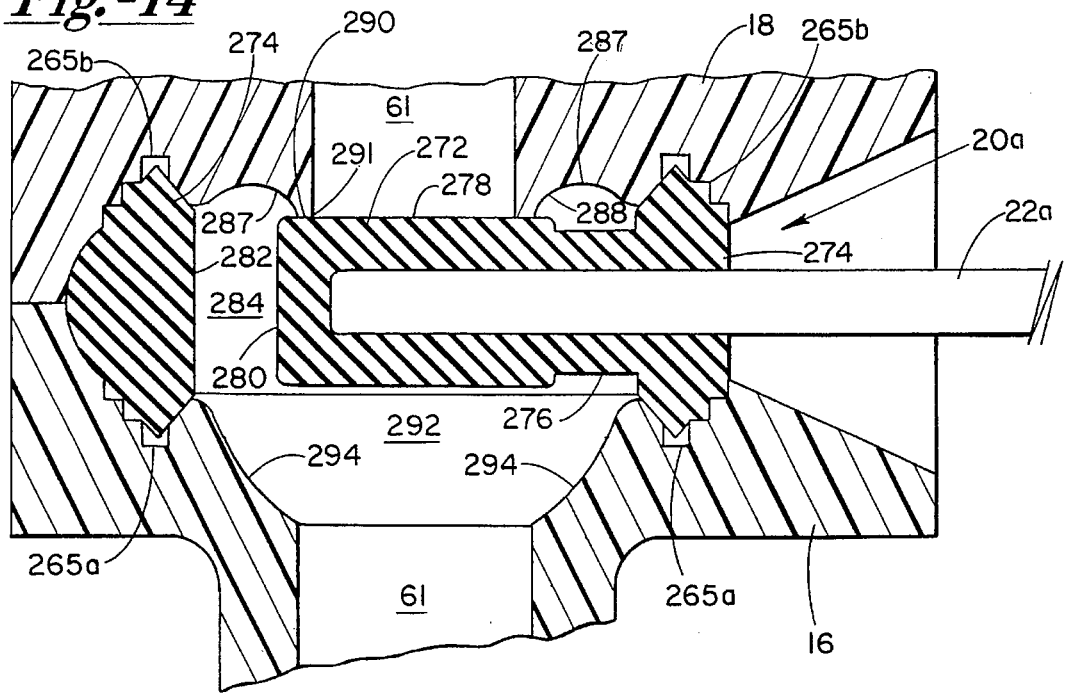
FIG. 14 shows the improved banjo valve and seat of the present invention.
Figure 15:
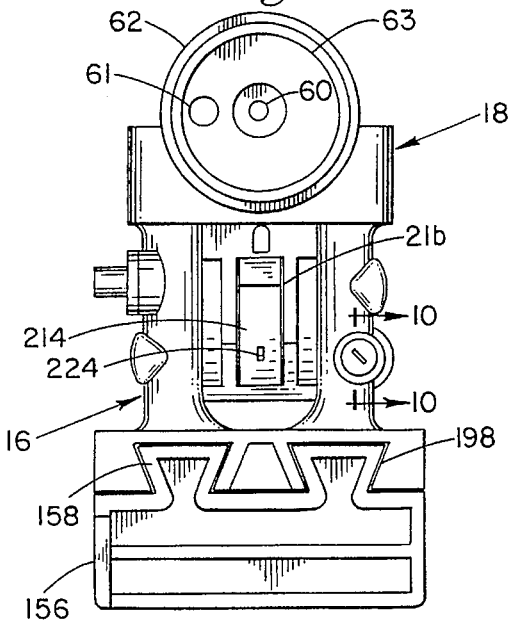
FIG. 15 shows a bottom plan view of the valve of the present invention.
Figure 16:
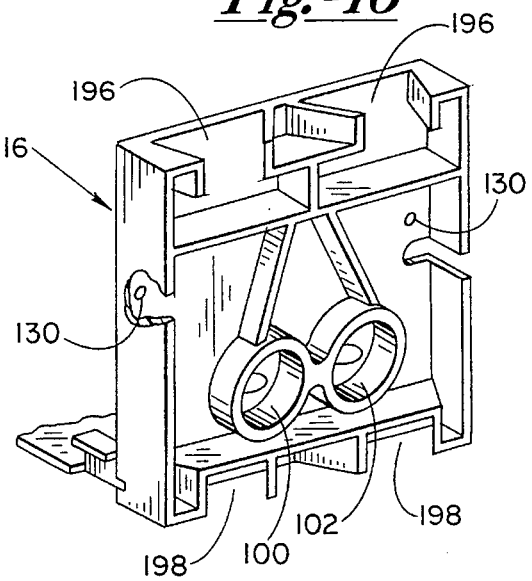
FIG. 16 shows a rear perspective view of the valve of the present invention.

The structures of a typical prior art banjo valve and its accompanying valve seat are seen in FIG. 13, and the improved banjo valve of the present invention and its accompanying seat are seen in FIG. 14. The structure of banjo valves 20*a* and 20*b* and their accompanying seats are essentially identical in structure, thus the description of one will be understood to apply to the other.

As seen in FIG. 13, a typical prior an banjo valve 250 is seen held between valve body portions V1 and V2. Valve 250 includes a central operating member or button 252 secured by a flexible bridge member 253 to an external ring 254. Button 252 has an exterior perimeter surface 255 and ring 254 includes an interior perimeter surface 256. Surfaces 255 and 256 define a circular gap 257 there between, wherein gap 257 is interrupted by bridge 253. An actuating arm 258 extends through button 252 connecting bridge 253 and a portion of ring 254. As is known, button 252, bridge 253 and ring 254 are formed of single piece of an elastomeric rubber secured to arm 258. Button 252 also includes a flat seating surface 259 and a semicircular lobe portion 260 opposite therefrom. Valve portions V1 and V2 include corresponding exterior circular grooves 261 and 262 respectively. Grooves 261 and 262, as is known in the art, provide for sealing and engagement of ring 254 therein. Valve body portion V1 includes a first exterior circular perimeter ridge 263 and an internal circular perimeter ridge 264. Ridge 264 includes an internal perimeter edge 264*a* and an external perimeter edge 264*b* defining a circular flat valve seating surface 265 against which surface 259 of button 252 seats. Valve body portion V2 includes a circular perimeter ridge 267 extending around button lobe end 260 in space 257.

As seen in FIG. 14, banjo valve 20*a* includes a central button 272 secured to a ring 274 by a flexible bridge 276. Button 272 includes a pair of flat seating surfaces 278 and an external perimeter surface 280. Ring 274 includes an internal perimeter surface 282 defining a circular space 284 extending between surfaces 282 and 280. Valve portion 16 and 18 include corresponding circular grooves 285*a* and 285*b* respectively, for retaining and sealing ring 274 therein. Valve body portion 18 includes a circular smooth concave arcuate surface 287 extending around button 272 and having a width extending substantially from ring surface 282 to an exterior seat perimeter edge 288. A flat valve seating surface 290 extends between an interior perimeter edge 291 and exterior perimeter edge 288. Valve body portion 16 includes an enlarged or relieved portion 292 of channel 61. Enlarged portion 292 is defined by a smooth arcuate concave perimeter surface 294 extending substantially from channel 61 to ring perimeter surface 282.

It can be appreciated by those with skill that the valve of the present invention has been designed to be assembled by hand and minimizing the need for any hand tools. The assembly of the valve of the present invention involves first securing together valve body portion 16 and 18 for holding there between banjo valves 20*a* and 20*b* and actuating arm 24. Specifically, valves 20*a* and 20*b* are retained in retaining grooves 285*a* and 285*b* and the pivot pin 24*a* of actuating arm 24 is retained between extensions 23*a* and 23*b*. The return springs 25 can then be inserted and retained by protrusions 18*a* and actuating arm extensions 23*a* and 23*b*. Solenoid 26 can then be secured to valve body portion 18 wherein the housing portion 26*a* fits under tab 28 and the U-shaped housing portion 26*b* is held by returns 30*a* of side tabs 30. It will be appreciated that forked end 24*c* slideably cooperates with groove 27*a* of piston 27. In the lever arm operated embodiment of the present invention a lever arm 208 can be inserted through opening 200 of base 32 wherein tabs 210 thereof provide for pivotal suspension thereof on rod 202. Micro switch 214 can be inserted into the retaining pocket 216 of valve body portion 16. Base 32 can then be secured to valve body portion 16 and 18 wherein edge end 40 is inserted into groove 41 and base arms 38 having returns 38*a* snap fit onto shoulders 39. The various electrical connections between switch 214 and solenoid 26 and a source of power can be easily accomplished with wires having plug-ins for cooperating with solenoid contacts 26*c* and switch contacts 222. Legs 104, 106, 108, and 110 of a-flow control 14 can then be inserted into columns 112, 114, 116, and 118 respectively after which U-shaped clip 132 can be inserted through holes 130 and slots 128 for retaining flow control 14 by interaction with notches 124 thereof. Housing 33 can then be secured to base 32 through the interaction thereof of ridges 37 and slots 36. Access cover 34 can then be secured to housing 33 by interaction of the respective ridges 37 thereof with slots 36 of housing 33. In particular, the bottom ridges 37 of cover 34 insert into and cooperate with notches 42. It will also be understood that ridges 37 of cover 34 include protrusion 37*a* for snap fitting cooperation with grooves 35*a*. In this manner after cover 34 has been put in place, cover 34, housing 33, and base 32 are secured together in an interlocking manner. In the lever arm operated embodiment it will be appreciated by those of skill that cover 34 includes no opening 54. Whereas, in the electronic portion control operated version of the present invention, prior to the securing of cover 34 to housing 33 a drawer 44 is inserted onto base 32 and held thereon. Cover 34 is then slid into place wherein lip 56 and vertical edges 58 overlap front surface 44*a* for preventing drawer 44 from sliding from base 32. It will also be appreciated that, in the electronic portion control operated embodiment, lever arm 208 is simply not inserted into base 32, nor is switch 214 inserted into body portion 16. Therefore, it can be seen that body portion 16 and base 32 are designed to accommodate either valve embodiment whether electronically portion controlled or mechanically lever operated. Pressure reducer 70 can then be inserted into syrup channel 60 after which retainer or housing 72 can be secured to base 32 by the bayonet operation described previously. Thus, other than the securing together of valve portion 16 and 18 which necessitates the use of a screwdriver for fastening by use of screws 19, the valve of the present invention can be assembled entirely by hand without the need for any further hand tools.

It will also be appreciated that flow control 14 can be assembled by placing of o-ring 145 around sleeve 44 and the insertion into sleeve 144 piston 142. Piston 142 and sleeve 144 can then be inserted into each halves of 140*a* and 140*b* after which springs 146 can be placed centrally within piston 142 and sleeve 144. Adjustment means 147 can be threadably engaged with nozzles 148*b* after which plates 148 can be placed over the openings of halves 140*a* and 140*b* after which retainer 149 can be secured to main body 138 thereby retaining the operating mechanism of each flow control half. Thus, flow control 14 can be assembled essentially entirely by hand other than a simple hand tool for securing retainer 149.

In the electronically controlled embodiment of the present invention, it can be appreciated that the retaining of solenoid 26 above base plate 32 provides space for electronics drawer 44. This ability represents an improvement over prior art valves wherein the pour switches and or electronics are secured to a portion of the exterior housing structures thereof. Thus, for example, removal of such a housing or portion thereof to adjust the flow control would be complicated by the wiring of the electronics. In the present invention, cover 34 can be fully removed to allow adjustment of flow control 14 by turning of adjustment means 147 without the complication of first removing wiring connections. It will be appreciated that nozzles 148*b* are positioned at an angle relative to the horizontal as represented by base 132. This angle serves to accommodate the placement of both the electronics and the solenoid 26 at the front end of valve 10. Thus, adjustment means 147 can be easily reached over solenoid 26 when access plate 34 is removed.

The operation of the electronic or lever operated embodiment of valve 10 involves the powering of solenoid 26 so that arm 24 is operated by piston 27 to actuate valve arms 22*a* and 22*b*. It can be appreciated that arm 24 operates to provide a lever advantage in the operating of stems 22*a* and 22*b* of valves 20*a* and 20*b*. Thus, solenoid 24 can be smaller and less expensive than in prior art valves wherein the solenoid piston directly actuates the valve stems without a leverage advantage.

Nozzle 64 provides for the gradual reduction in pressure of the beverage components from that as supplied by the flow control means 14 to that of atmospheric. In this manner the syrup and carbonated water can be relatively gently mixed so that foaming and loss of carbonation is reduced. In particular, when nozzle 64 is secured to valve body 18, tube end 74 is sealably inserted into syrup channel 60 whereby diffuser plate 78 is inserted partially into the area defined by rim 63 and body portion 18 forming annular space 87. When valves 20*a* and 20*b* are operated syrup and carbonated water flow through channels 60 and 61 respectively. The carbonated water first flows into space 87 and then through holes 78*a* of diffuser 78 and into cavity 82. In cavity 82 the carbonated water then flows over the surface of frustoconical portion 80 and is dispersed over a greater surface area thereby and then directed to space 88 and over diffuser plate 84. The carbonated water next flows through holes 84 into space 89 and then through holes 86*a* of diffuser 86 and then into area 91. In area 91 the carbonated water flows in past along the surface of shoulder 92 and in past downward from diffuser 86. The syrup flows through channel 90 and exits channels 90*a* in a direction towards inclined shoulder 92. Thus, the syrup is mixed with the carbonated water wherein the stream thereof flowing from channels 90*a* contacts the water as it flows downward from plate 86 and contacts the syrup stream and as a portion of the stream contacts shoulder 92 and combines with the portion of water flowing along the surface thereof. The water and syrup are then substantially combined and flow out of orifice 93 and into a suitable receptacle. An important aspect of the present invention concerns the gradual reducing in pressure of the carbonated water to that of atmospheric. That is accomplished in the several steps outlined above. Specifically, there is a partial reduction in pressure when the water flows into each successive annular space wherein the surface area of the holes in plates 78, 84 and 86 increases from plate to plate in the direction of flow. Conical surface 80 also serves to decrease the velocity of flow by distribution over a larger surface area in addition to reducing the pressure partially to atmospheric. A further important aspect of plates 78, 84 and 86 concerns the perimeters thereof contacting the inner surface of retainer 72. In this manner the reduction in pressure as a function of the surface area of holes therein can be controlled solely as a function of such surface area. This situation is in contrast to the prior art valve inserts wherein the diffuser plates thereof permit the flow of beverage between the perimeter diffuser edge and the nozzle outer housing. It can also be desirable to secure the perimeter edge of one or more of the diffuser plates 78, 84 and 86 to the inner surface of retainer 72 to better prevent beverage flow there between.

As is known in the art, flow control 14 provides for the proper ratioing of the carbonated water and the syrup beverage components. As is understood, fluid pressure against surface 142*a* of piston 142 serves to regulate the size of the openings 144*a* of sleeve 144. The size of openings 144*a* is regulated by the position of top perimeter edge 142*c* of piston 142. Thus, carbonated water can enter through channel 100 into annular space 144*a* and flow through orifice 142*b*. The carbonated water then flows through orifice holes 144*a* and into annular chamber 150*b*. The carbonated water is then fluidly communicated through leg 110 to carbonated water channel 61. It can be appreciated that o-ring 145 provides for the fluid separation of annular chambers 150*a* and 150*b*. In the preferred form of the present invention piston 142 and sleeve 144 are made of a ceramic material. As is also known in the art, the opposing pressure against piston 142 is provided by spring 146. Thus, tensioning means 147 provides for adjusting the tension applied to spring 146 for compensating for the fluid pressure of the carbonated water or syrup. With proper adjustment of both halves 140*a* and 140*b*, the proper ratio of fluids can be attained. It will be appreciated by those with skill that flow control 14 is of the conventional piston type. However, it is contemplated that various other forms of flow controls can be configured to be releasably securable to body portion 16 in the same manner as flow control 14. An example of an alternate form of flow control 14 is seen in U.S. Pat. No. 5,156,301 issued Oct. 20, 1992 and U.S. Pat. No. 5,012,837 issued May 7, 1991, which U.S. Patents are incorporated here by reference. These patents both disclose the use of a gear pump having pairs of elliptical gears for providing the necessary ratioing of the carbonated water and syrup components. Such flow controls also include four legs for cooperating with body portion 16 in the same manner as flow control 14. Thus, it can be appreciated by those with skill that the valve of the present invention can provide the flexibility of providing for modular interchangeability of various types of flow controls and/or automatic ratioing controls. Like flow control 14, the gear pumps of the above referenced U.S. Patents provide for automatic ratioing of the two beverage components, however they do have more restrictive operating requirements with respect to the pressure, particularly that of the carbonated water. Thus, if the pressure thereof is too great there is a tendency for the carbonated water to flow past the elliptical gears thereby impairing the ability thereof to properly ratio the two liquids. Thus, flow restrictor 136 provides a means for adjusting the rate of flow of the carbonated water down to a lower pressure range that the gear type rationing device requires to operate properly. It can be understood that if the carbonated water pressure is too great, the end 136*a* can be threadably inserted partially into channel 100 for restricting the flow of carbonated water therethrough. When using flow control 14 restrictor 136 would be fully retracted wherein the end 136*a* thereof would not restrict the flow of carbonated water through channel 100.

Figure 21:
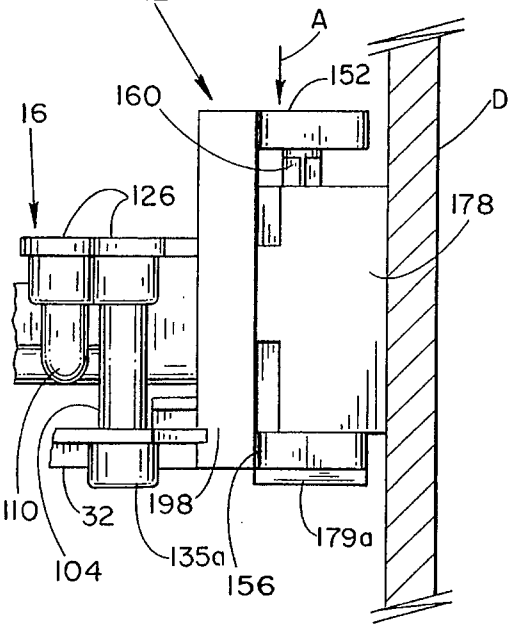
FIG. 21 shows a side plan view of the quick disconnect wherein the valve is secured thereto.

The Operation of the quick disconnect of the present invention can be understood by referring to FIGS. 15, 16 and 18–23. Specifically, as seen in FIG. 21, disconnect 12 provides for securing of valve 10 to a dispenser D. To remove valve 10 from dispenser D involves pressing downwardly in the direction of arrow A in FIG. 21 on top plate 52 while bending flange 179 so that the end 179*a* thereof no longer retains plate 156. It can be understood that tabs 154 of plate 152 will then be removed from pockets 196 while simultaneously tabs 158 of bottom plate 156 are removed from pockets 198. At the same time, rods 160 move downwardly wherein blocking portions 164 are positioned in front of the reduced diameter orifices 188 of syrup inlet 180 and water inlet 182. Prior to such movement of plates 152 and 156 and rods 160, the annular space 199 extending around reduced diameter portions 162 provide for fluid communication between inlets 180 and 182 and outlets 184 and 186 respectfully. Thus, it can be appreciated that rods 160 comprise barrel valves wherein such valves provide for fluid communication to valve 10 when tabs 154 and 158 are seated in their respective pockets, 196 and 198. With the tabs 154 and 158 removed from their respective pockets, it can be appreciated that valve 10 can be removed in the direction of arrow B in FIG. 23 and fluid flow from disconnect 12 will not occur. Of course, reattachment of valve 10 involves reinserting tubes 190 and 192 into channels 102 and 100, and then moving plates 152 and 154 upward as indicated by arrow C in FIG. 23. Thus, tabs 154 and 158 are then reseated in their respective pockets 196 and 198, blocking portions 164 moved away from orifices 188 permitting fluid flow to valve 10. Flange 179 then also snaps into place under plate 156. Flange 179 provides for a locking means for preventing any unwanted downward disconnecting movement of plates 152 and 156.

The assembly of disconnect 12 can also be done completely manually. Rods 160 are first fitted with o-rings 168 and then inserted into bores 176 in block 178. Arms 170 are inserted into holes 175 wherein returns 172 expand in slots 174 to provide for snap fitting securing on surfaces 174*a* thereby securing plate 152 to rods 160.

The improvement of the banjo valve and seat of the present invention can be understood by referring to FIGS. 13 and 14. Valve body portion 18 includes a smooth arcuate concave perimeter surface 287 having a width extending substantially between the perimeter surface 280 of button 272 and the perimeter surface 282 of ring 274. In contrast, in the valve seat surface of valve portion V1, as represented in the typical prior art embodiment of FIG. 13, there exists an exterior ridge 263 and an interior ridge 264 having a plurality of fiat surfaces extending at various angles. It has been found that surface 287 of the present invention provides for improved and less restricted flow of carbonated water or syrup. And, particularly in the case of carbonated water, this enhanced flow provided by surface 287 results in less break-out of carbon dioxide gas from the water. This has also been found to be the case with respect to surface 294 of valve portion 16. As seen in the prior art, such surface area typically includes a ridge 267. Thus, in the present invention such ridge has been eliminated and replaced with a smooth arcuate surface 294 over the enlarged cavity portion 292 extending from the channel 61 to substantially the inner perimeter surface 282 of ring 274. Thus, it has been found that providing for smooth ridgeless surfaces both on the distal and proximal ends of the banjo valve cavity provides for an enhanced and less disruptive fluid flow. It has also been found that lobe end 260 of button 252, as seen in prior art embodiments, can be eliminated. In the present embodiment, button 272 preferably has identical flat surfaces 278 on either side thereof. Elimination of which lobe portions was found to increase flow rate, and confers the advantage of providing for a banjo valve that can be seated in either of two ways.

What is claimed is:

1. A post-mix beverage dispensing valve, comprising:

a main valve body having a rear end for releasable connecting to sources of liquid beverage components, and a front end opposite therefrom, the main body having a plurality of beverage channels extending there through from the rear end to a nozzle adjacent the front end, and the main body having a banjo valve in each channel, and the main body having means for snap fitting securing of a solenoid thereto, the solenoid for operating the banjo valves so that the beverage components can flow from the sources thereof to the nozzle for dispensing therefrom into a suitable container;

a base plate for snap fitting securing to a bottom surface of the main body;

a housing cover for slideable engaging with the base plate;

an access cover for snap fitting engaging with the base plate and the housing cover for forming an interlocking cover around the main body.

2. The valve as defined in claim 1, and the base plate having a hole having a pivotal support for receiving a lever arm for pivotal suspending of the arm from the base plate, and the main body having a switch receiving pocket for snap fitting receiving of a valve operating switch therein, and the switch contacted by the arm for operating the solenoid.

3. The valve as defined in claim 2, and including a flow control unit for controlling the flow of each beverage component and the control unit releasably securable to the beverage channels of the main body.

4. The valve as defined in claim 1, and the solenoid secured to the main body on the front end thereof and positioned thereon above the base plate so that an electronics retaining space is formed between the solenoid and the base plate.

5. The valve as defined in claim 4, and the base plate having means for releasably retaining an electronics drawer in the electronics retaining space, the drawer for holding an electronic circuit, the circuit connected to the solenoid and an electrical power source for controlling the operation of the valve.

6. The valve as defined in claim 5, and the circuit being of the portion control type and the drawer having a front surface for retaining a plurality of drink size selection switches thereon, and the access cover adapted to retain the drawer in the retaining space, to permit easy access to and operation of the size selection switches and to permit removal thereof from the base plate and housing cover without requiring removal of the drawer and associated circuit from the electronics retaining space.

7. A banjo valve retaining cavity formed within a valve body for retaining a banjo valve therein, the banjo valve having an operating button, a sealing ring around the button and a flexible bridge securing the button to the ring and an operating arm secured within the button, and the button having an external perimeter surface and the ring having an internal perimeter surface, and the ring and button perimeter surfaces spaced from each other and defining an annular space them between, and the button further having a flat seating surface, and the valve body having an inlet channel in fluid communication with a proximal end of the valve cavity and an outlet channel in fluid communication with a distal end of the valve cavity, and the inlet channel connectable to a source of a liquid, the valve cavity comprising:

complimentary ring retaining grooves in the proximal and distal cavities for sealably retaining the banjo valve ring therein;

the proximal cavity end having a fiat seating surface extending around the outlet channel for cooperating with the fiat seating surface of the button, and the proximal cavity end having a smooth concave surface extending around the proximal cavity seating surface externally thereof, and the concave surface having a width extending substantially from the ring internal perimeter surface to the button external perimeter surface.

8. The valve cavity as defined in claim 7, and the proximal cavity end having an enlarged portion extending from the inlet channel to the ring groove thereof, and the enlarged portion having a smooth arcuate surface.

9. A beverage dispensing valve, comprising:

a main valve body having a rear end for releasable connecting to sources of liquid beverage components, and a front end opposite therefrom, the main body having one or more beverage channels extending there through from the rear end to a nozzle extending from a bottom end of the main body, and the main body having valve means in each one or more channel, valve operating means for operating the one or more valve means to open and close so that the beverage components can flow from the sources thereof to the nozzle for dispensing therefrom into a suitable container, a base plate for snap fitting securing to the bottom end of the main body, a housing cover for slideable engaging with the base plate, an access cover for snap fitting engaging with the base plate adjacent to and along the main body front end and the base plate, housing cover and access cover forming an interlocking valve cover defining a substantially closed interior volume extending around the main body.

10. The valve as defined in claim 9, and the base plate having a hole having a pivotal support for receiving a lever arm for pivotal suspending of the arm from the base plate, and the main body having a switch receiving pocket for snap fitting receiving of a valve operating switch therein, and the switch contacted by the arm for operating the solenoid.

11. The valve as defined in claim 9, and including a flow control unit for controlling the flow of each beverage component and the control unit manually releasably securable to the one or more beverage channels of the main body.

12. The valve as defined in claim 9, and the base plate having means for slidably retaining an electronics drawer along a top surface thereof, the drawer for holding an electronic circuit, the circuit connected to the solenoid and an electrical power source for controlling the operation of the valve operating means.

13. The valve as defined in claim 9, and the base plate having means for slidably retaining an electronics drawer along a top surface thereof, the drawer for holding an electronic circuit, the circuit connected to the solenoid and an electrical power source for controlling the operation of the valve operating means and the electronics drawer receivable on the base plate top surface prior to the interlocking of the access cover with the base plate and housing cover for retaining the electronics drawer within the interior volume of the interlocking valve cover.

14. The valve as defined in claim 13, and the electronics drawer having a front surface for retaining one or more user operable switches for providing inputs to the electronic control, and the electronics drawer front surface substantially adjacent to and co-extensive with a front surface of the access cover wherein the access cover front surface has a recess area having a perimeter substantially coextensive with and slightly overlapping of a perimeter of the electronics drawer front surface for retaining and substantially sealing the electronics drawer within the interlocking valve cover interior volume while permitting direct user access to the one or more switches.

15. The valve as defined in claim 9, and the valve operating means comprising a solenoid and the valve main body have means for snap fitting retaining of the solenoid.

16. The valve as defined in claim 15, and the base plate having a hole having a pivotal support for receiving a lever arm for pivotal suspending of the arm from the base plate, and the main body having a switch receiving pocket for snap fitting receiving of a valve operating switch therein, and the switch contacted by the arm for operating the solenoid.

17. The valve as defined in claim 16, and including a flow control unit for controlling the flow of each beverage component and the control unit manually releasably securable to the one or more beverage channels of the main body.

18. The valve as defined in claim 17, and the base plate having means for slidably retaining an electronics drawer along a top surface thereof, the drawer for holding an electronic circuit, the circuit connected to the solenoid and an electrical power source for controlling the operation of the valve operating means.

19. The valve as defined in claim 17, and the base plate having means for slidably retaining an electronics drawer along a top surface thereof, the drawer for holding an electronic circuit, the circuit connected to the solenoid and an electrical power source for controlling the operation of the valve operating means and the electronics drawer receivable on the base plate top surface prior to the interlocking of the access cover with the base plate and housing cover for retaining the electronics drawer within the interior volume of the interlocking valve cover.

20. The valve as defined in claim 19, and the electronics drawer having a front surface for retaining one or more user operable switches for providing inputs to the electronic control, and the electronics drawer front surface substantially adjacent to and co-extensive with a front surface of the access cover wherein the access cover front surface has a recess area having a perimeter substantially coextensive with and slightly overlapping of a perimeter of the electronics drawer front surface for retaining and substantially sealing the electronics drawer within the interlocking valve cover interior volume while permitting direct user access to the one or more switches.

21. A beverage dispensing valve, comprising:

a main valve body having a rear end for releasable connecting to sources of liquid beverage components, and a front end opposite therefrom, the main body having one or more beverage channels extending there through from the rear end to a nozzle adjacent extending from a bottom end of the main body, and the main body having valve means in each one or more channel, and a solenoid for operating the one or more valve means to open and close so that the beverage components can flow from the sources thereof to the nozzle for dispensing therefrom into a suitable container, and the valve main body have means for snap fitting retaining of the solenoid thereto.

22. The valve as defined in claim 21, and further including a base plate for snap fitting securing to the bottom end of the main body, and the base plate having a hole having a pivotal support for receiving a lever arm for pivotal suspending of the arm from the base plate, and the main body having a switch receiving pocket for snap fitting receiving of a valve operating switch therein, and the switch contacted by the arm for operating the solenoid.

23. The valve as defined in claim 22, and further including a housing cover for slideable engaging with the base plate, an access cover for snap fitting engaging with the base plate and the housing cover for forming an interlocking cover defining a substantially closed interior volume extending around the main body.

24. The valve as defined in claim 23, and the base plate having means for slidably retaining an electronics drawer along a top surface thereof, the drawer for holding an electronic circuit, the circuit connected to the solenoid and an electrical power source for controlling the operation of the valve operating means and the electronics drawer receivable on the base plate top surface prior to the interlocking of the access cover with the base plate and housing cover for retaining the electronics drawer within the interior volume of the interlocking valve cover.

25. The valve as defined in claim 24, and the electronics drawer having a front surface for retaining one or more user operable switches for providing inputs to the electronic control, and the electronics drawer front surface substantially adjacent to and co-extensive with a front surface of the access cover wherein the access cover front surface has a recess area having a perimeter substantially coextensive with and slightly overlapping of a perimeter of the electronics drawer front surface for retaining and substantially sealing the electronics drawer within the interlocking valve cover interior volume while permitting direct user access to the one or more switches.

26. A beverage dispensing valve, comprising:

a main valve body having a rear end for releasable connecting to sources of liquid beverage components, and a front end opposite therefrom, the main body having one or more beverage channels extending there through from the rear end to a nozzle adjacent extending from a bottom end of the main body, and the main body having valve means in each one or more channel, and a solenoid for operating the one or more valve means to open and close so that the beverage components can flow from the sources thereof to the nozzle for dispensing into a suitable container, and a base plate for snap fitting securing to the bottom end of the main body, and the base plate having a hole having a pivotal support for receiving a lever arm for pivotal suspending of the arm from the base plate, and the main body having a switch receiving pocket for snap fitting receiving of a valve operating switch therein, and the switch contacted by the arm for operating the solenoid.

27. The valve as defined in claim 26, and further including means for providing snap fitting retaining of the solenoid to the valve main body.

28. The valve as defined in claim 26, and further including a housing cover for slideable engaging with the base plate, and an access cover for snap fitting engaging with the base plate and the housing cover for forming an interlocking cover defining a substantially closed interior volume extending around the main body.

29. The valve as defined in claim 28, and the base plate having means for slidably retaining an electronics drawer along a top surface thereof, the drawer for holding an electronic circuit, the circuit connected to the solenoid and an electrical power source for controlling the operation of the valve operating means and the electronics drawer receivable on the base plate top surface prior to the interlocking of the access cover with the base plate and housing cover for retaining the electronics drawer within the interior volume of the interlocking valve cover.

30. The valve as defined in claim 29, and the electronics drawer having a front surface for retaining one or more user operable switches for providing inputs to the electronic control, and the electronics drawer front surface substantially adjacent to and co-extensive with a front surface of the access cover wherein the access cover front surface has a recess area having a perimeter substantially coextensive with and slightly overlapping of a perimeter of the electronics drawer from surface for retaining and substantially sealing the electronics drawer within the interlocking valve cover interior volume while permitting direct user access to the one or more switches.

* * * * *